US007479028B1

(12) United States Patent
Pottorff

(10) Patent No.: US 7,479,028 B1
(45) Date of Patent: Jan. 20, 2009

(54) CHARGER CONNECTOR APPARATUS

(76) Inventor: Lawrence P. Pottorff, 3813 Juniper Ave., Joliet, IL (US) 60431

( * ) Notice: Subject to any disclaimer, the term of this patent is extended or adjusted under 35 U.S.C. 154(b) by 0 days.

(21) Appl. No.: 11/958,969

(22) Filed: Dec. 18, 2007

(51) Int. Cl.
*H01R 13/58* (2006.01)

(52) U.S. Cl. ..... 439/472

(58) Field of Classification Search ..... 439/657, 439/659, 661, 680, 681, 295, 679, 693, 691, 439/472

See application file for complete search history.

(56) References Cited

U.S. PATENT DOCUMENTS

| | | | | |
|---|---|---|---|---|
| 3,184,703 | A | 5/1965 | Piscitello et al. | |
| 3,670,289 | A * | 6/1972 | Bruner | 439/357 |
| 3,909,099 | A * | 9/1975 | Winkler | 439/295 |
| 4,853,606 | A | 8/1989 | Nakai | |
| 4,895,530 | A | 1/1990 | Gugelmeyer et al. | |
| 5,646,507 | A | 7/1997 | Timmons et al. | |
| 5,688,460 | A | 11/1997 | Ruschke | |
| D419,133 | S | 1/2000 | Yoshida et al. | |
| 6,805,593 | B2 | 10/2004 | Spaulding et al. | |
| 2004/0048512 | A1 | 3/2004 | Chen | |

* cited by examiner

*Primary Examiner*—Neil Abrams
*Assistant Examiner*—Phuong Nguyen
(74) *Attorney, Agent, or Firm*—Crossley Patent Law; Mark A. Crossley

(57) ABSTRACT

The charger connector apparatus comprises an improved SB and SBX-style connector such as those typically employed in charging industrially used batteries. A primary difference of the apparatus from those presently in use is that it includes an integral cable/wire platform and clamp assembly on one end. The winged clamp securely and selectively holds the two DC wires which are fed into the clamp, wires which heretofore were subject to pulling out and to abrasion.

1 Claim, 3 Drawing Sheets

CHARGER CONNECTOR APPARATUS

BACKGROUND OF THE INVENTION

Existing types of connectors used in charging industrial batteries are known in the art as SB and SBX-style connectors. Retaining positive connection with these existing connectors is a long-standing problem. As a result of this problem, a device is considered required and is routinely sold which attempts to metallically clamp these connectors to prevent disengagement; however, the device is problematic, even to the point that users refuse to purchase the required device. Other than the failure of this existing clamping device to properly perform, the metallic makeup of the device places the connections and wires at the SB and SBX-style connector at substantial risk of electrical short. The present apparatus solves these problems with a basic improvement to the SB and SBX-style connectors.

FIELD OF THE INVENTION

The charger connector apparatus relates to existing battery charging connectors and more specifically to improvements to SB and SBX-style battery charger connectors.

SUMMARY OF THE INVENTION

The general purpose of the charger connector apparatus, described subsequently in greater detail, is to provide a charger connector apparatus which has many novel features that result in an charger connector apparatus which is not anticipated, rendered obvious, suggested, or even implied by prior art, either alone or in combination thereof.

To attain this, the charger connector apparatus comprises an improved SB and SBX-style connector such as those typically employed in charging industrially used batteries such as truck batteries, fork lift batteries, and the like. The apparatus is similar in size and shape to those currently used. The apparatus therefore can be produced in a variety of sizes and power ratings needed for the various charging practices. A primary difference of the apparatus from those presently in use is that it includes an integral cable/wire platform and clamp assembly on one end. The features of the clamp and platform include platform raised outer ridges, each of which includes a flare seat for acceptance of the respective flares of the clamp. The winged clamp securely and selectively holds the two DC wires which are fed into the clamp, wires which heretofore were subject to pulling out and to abrasion. The threaded hole for acceptance of the machine screw which holds the clamp is reinforced for strength and durability of the apparatus. Enhanced grip is also featured on the apparatus. Features of the apparatus are provided with only a minor increase in cost, and no decrease in overall strength, durability, and load carrying capacity.

Thus has been broadly outlined the more important features of the improved charger connector apparatus so that the detailed description thereof that follows may be better understood and in order that the present contribution to the art may be better appreciated.

An object of the charger connector apparatus is to prevent problems with existing SB and SBX-style connectors and their associated clamps.

A further object of the charger connector apparatus is to negate electrical shorts associated with SB and SBX-style connectors and clamps.

These together with additional objects, features and advantages of the improved charger connector apparatus will be readily apparent to those of ordinary skill in the art upon reading the following detailed description of presently preferred, but nonetheless illustrative, embodiments of the improved charger connector apparatus when taken in conjunction with the accompanying drawings.

In this respect, before explaining the current embodiments of the improved charger connector apparatus in detail, it is to be understood that the charger connector apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved charger connector apparatus. It is therefore important that the claims be regarded as including such equivalent constructions insofar as they do not depart from the spirit and scope of the charger connector apparatus. It is also to be understood that the phraseology and terminology employed herein are for purposes of description and should not be regarded as limiting.

BRIEF DESCRIPTION OF THE DRAWINGS

FIG. 3 is a cross sectional view of FIG. 1.

DETAILED DESCRIPTION OF THE DRAWINGS

With reference now to the drawings, and in particular FIGS. 1 through 6 thereof, the principles and concepts of the charger connector apparatus generally designated by the reference number 10 will be described.

Figure 1:
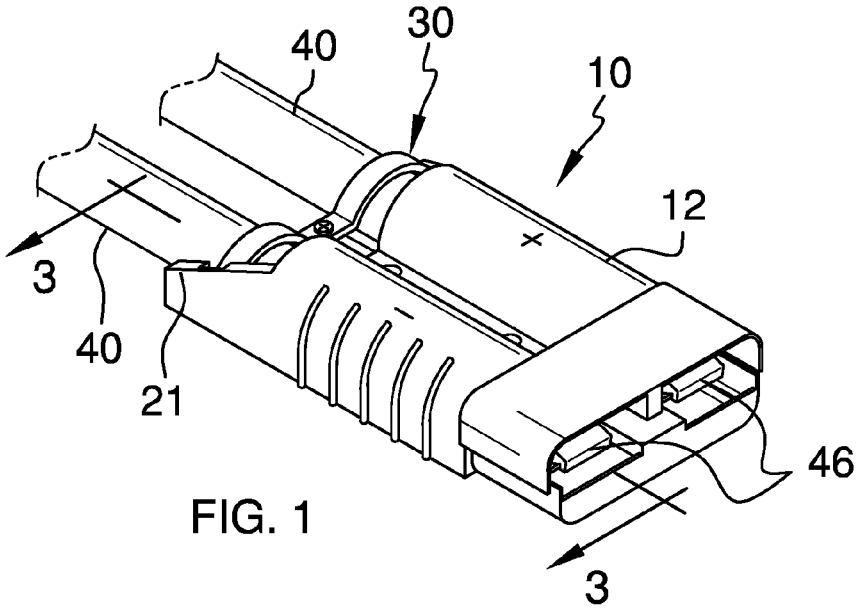
FIG. 1 is a perspective view of the apparatus in use with 2 wires with contacts.
Figure 2:
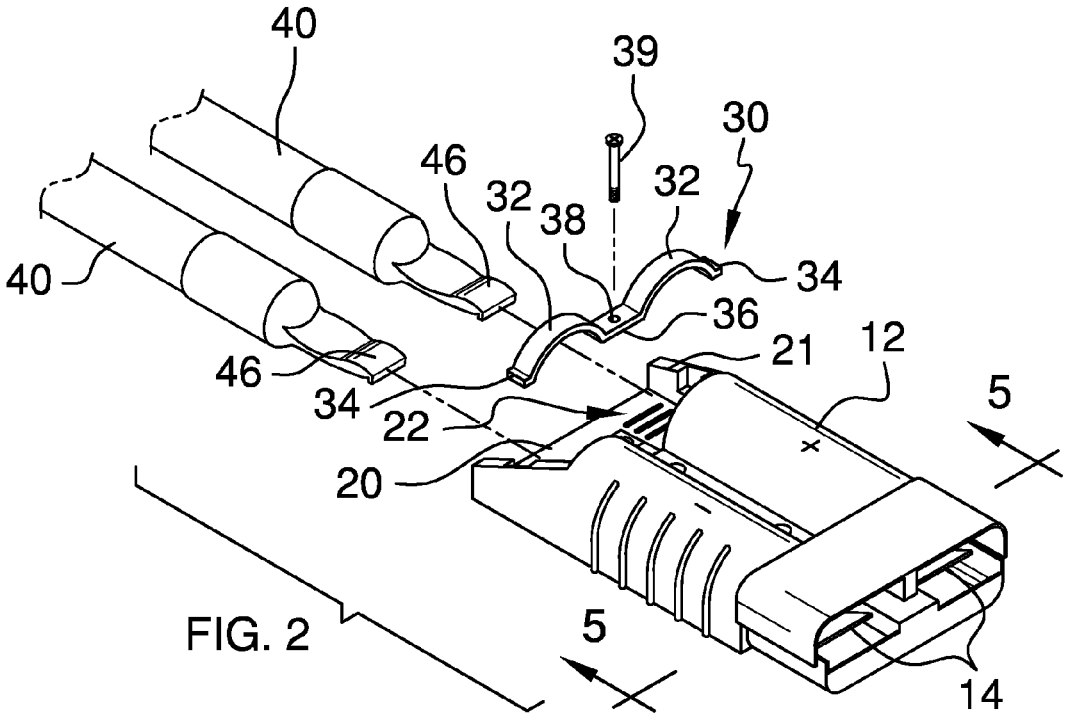
FIG. 2 is an exploded view of FIG. 1, the apparatus in preparation of use.
Figure 3:
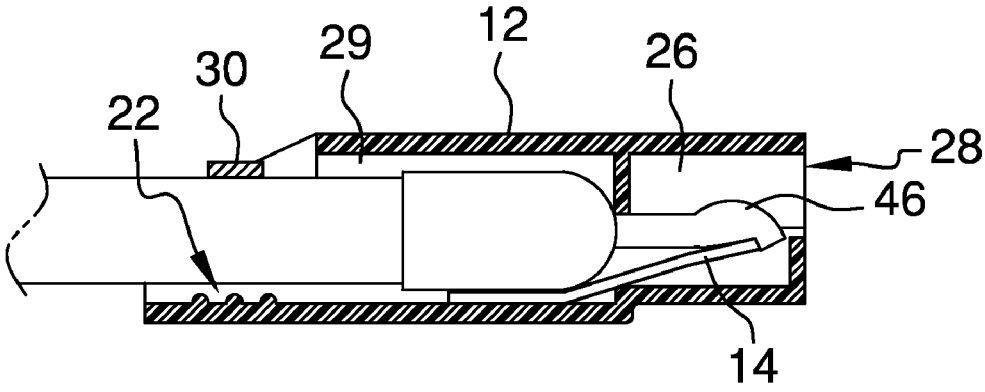
FIG. 3 is
Figure 4:
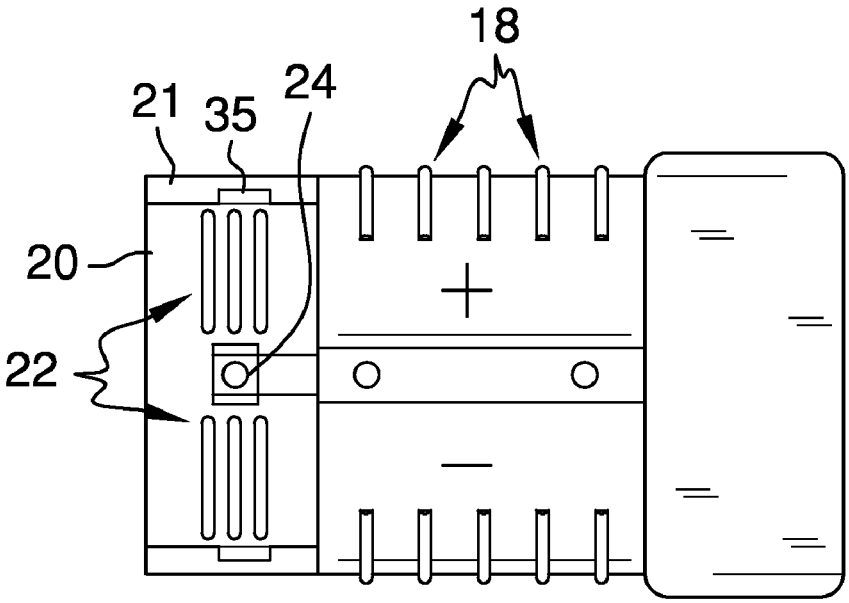
FIG. 4 is a top plan view of the apparatus, minus the clamp and machine screw.
Figure 5:
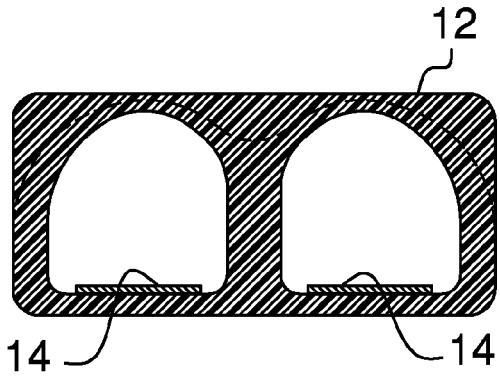
FIG. 5 is a cross sectional end view of the apparatus of FIG. 2

Referring to FIG. 1, the charger connector apparatus 10 comprises a connector 12 for accepting two electrical wires 40. The clamp 30 selectively secures the wires 40 against removal and against chafing.

Referring to FIGS. 2-5, the apparatus 10 accepts the wires 40 with contacts 46 (not a part of the apparatus 10) and also accepts a charging plug (not shown, not a part of the apparatus 10). The connector 12 has a first end and a second end. The connector 12 further comprises a platform 20 at the first end of the connector 12. A plurality of ribs 22 is disposed on the platform 20. The ribs 22 decrease the likelihood of wires 40 moving within and slipping from the connector 12. The reinforced threaded hole 24 is disposed in an approximate center of the platform 20. A ridge 21 is disposed on each side of the platform 20. A flare seat 35 is disposed in each ridge 21. The pair of spaced apart wire cavities 29 are disposed medially adjacent to the platform 20. Each cavity 29 provides for acceptance of one wire 40. The pair of spaced apart contact openings 26 is proximal to the second end of the connector 12. Each contact opening 26 is in communication with one of the wire cavities 29. A contact passage 28 is disposed at the second end of each of the contact openings 26. Each contact passage 28 and contact opening 26 is for removable acceptance of a charging plug. A flat spring 14 is disposed within each wire cavity 29 and within each contact opening 26. Each spring 14 is slanted upwardly within each contact opening 26 in order to upwardly tension the contact 46. A plurality of spaced apart grips 18 is disposed on each side and part of the top of the exterior of the connector 12 in order to enhance grip for a user. The removable non-metallic clamp 30 is provided for simultaneously clamping each wire 40 to the platform 20 of the connector 12. The clamp 30 comprises a pair of spaced apart convex wings 32 joined by a central flat junction 36. The orifice 38 is disposed in the center of the flat junction 36. A horizontal flare 34 is disposed at the outer end of each wing 32. Each flare 34 is for selective placement into one of the flare seats 35 of the platform ridges 21. The machine screw 39 is for passing through the orifice 38 of the flat junction 36 and into the threaded hole 24 of the platform 20. The design of the platform 20 and clamp 30 provided for securely holding the wires 40 while simultaneously negating any concerns by overtightening by a user.

In using the apparatus 10, the user pushes each wire 40 into the connector until the contact 46 engages the flat spring 14. The clamp 30 is then tightened against the wires 40 with the machine screw 39 until the wires 40 are firmly secured. A charging plug can then be inserted into the second end of the apparatus such that the contacts are engaged. Removal is a reversal of the above procedure.

Figure 6:
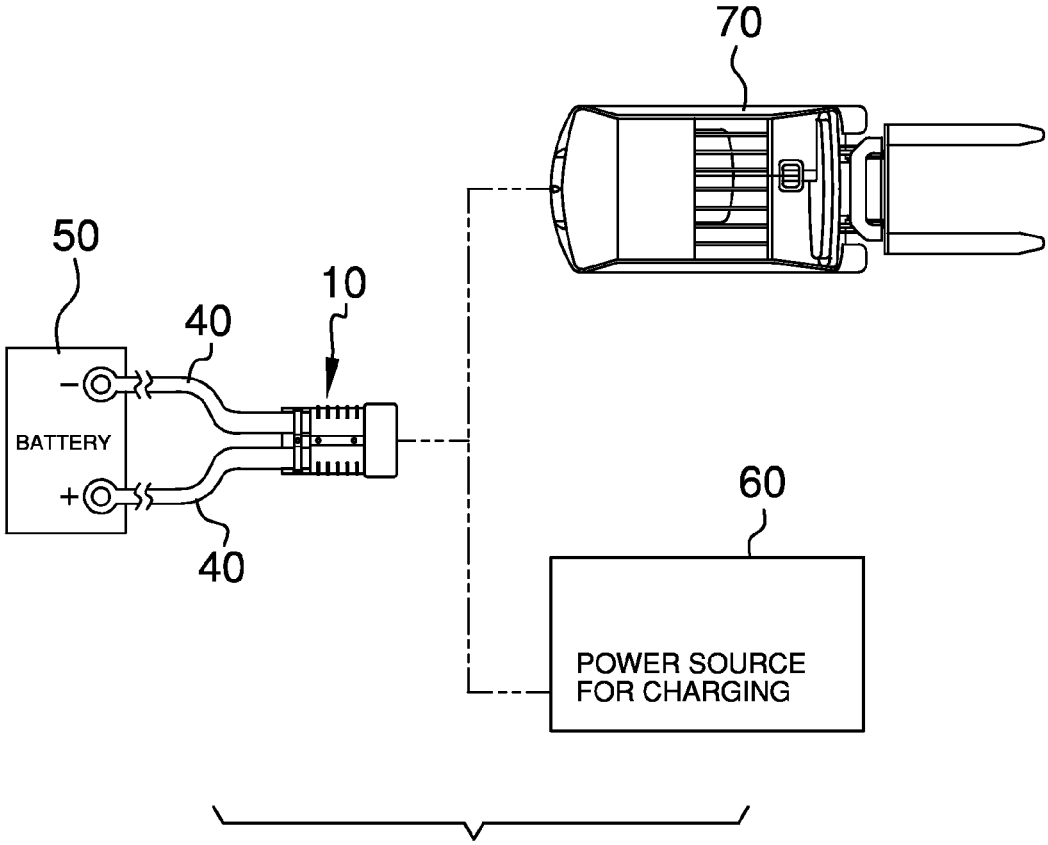
FIG. 6 is a top plan view of the apparatus in use, including a power source and forklift for which the battery may be used.

Referring to FIG. 6, the battery 50 is fitted with wires 40 which are plugged and secured into the apparatus 10. The battery 50 is charged by the power source 60 and can then be used to power the forklift 70.

With respect to the above description then, it is to be realized that the optimum dimensional relationships for the parts of the charger connector apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the charger connector apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the charger connector apparatus may be used.

Therefore, the foregoing is considered as illustrative only of the principles of the charger connector apparatus. Further, since numerous modifications and changes will readily occur to those skilled in the art, it is not desired to limit the charger connector apparatus to the exact construction and operation shown and described, and accordingly, all suitable modifications and equivalents may be resorted to, falling within the scope of the charger connector apparatus.

What is claimed is:

1. A charger connector apparatus, comprising:

a connector for accepting two electrical wires with contacts and for accepting a charging plug, the connector having a first end and a second end, the connector further comprising:

a platform at the first end of the connector;

a plurality of ribs disposed on the platform;

a reinforced threaded hole in an approximate center of the platform;

a ridge on an each side of the platform;

a flare seat disposed in each ridge;

a pair of spaced apart wire cavities medially adjacent to the platform, each cavity for accepting one wire;

a pair of contact openings proximal to the second end of the connector, each contact opening in communication with one of the wire cavities;

a contact passage at the second end of each of the contact openings, each contact passage and contact opening for removable acceptance of a charging plug;

a flat spring disposed within each wire cavity and within each contact opening, each spring slanted upwardly within each contact opening;

a plurality of spaced apart grips on each side and a part of a top of an exterior of the connector;

a removable non-metallic clamp for simultaneously clamping each wire to the platform of the connector, the clamp comprising:

a pair of spaced apart convex wings joined by a central flat junction;

an orifice in a center of the flat junction;

a flare at an outer end of each wing, each flare coplanar to the flat junction, each flare for selective placement into one of the flare seats of the platform ridges;

a machine screw for passing through the orifice of the flat junction and into the threaded hole of the platform.

* * * * *